US008319719B2

(12) United States Patent
Matsumoto et al.

(10) Patent No.: US 8,319,719 B2
(45) Date of Patent: Nov. 27, 2012

(54) LIQUID CRYSTAL DISPLAY DEVICE

(75) Inventors: Tomohiro Matsumoto, Tokyo (JP); Takayoshi Tsukamoto, Tokyo (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 616 days.

(21) Appl. No.: 12/370,931

(22) Filed: Feb. 13, 2009

(65) Prior Publication Data

US 2009/0231261 A1 Sep. 17, 2009

(30) Foreign Application Priority Data

Feb. 15, 2008 (JP) ..... 2008-34835

(51) Int. Cl.
*G09G 3/36* (2006.01)

(52) U.S. Cl. ..... 345/98; 345/87; 345/99

(58) Field of Classification Search ..... 345/87, 345/98

See application file for complete search history.

(56) References Cited

U.S. PATENT DOCUMENTS

| | | | | |
|---|---|---|---|---|
| 2003/0067429 | A1 * | 4/2003 | Aoki et al. | 345/87 |
| 2003/0076385 | A1 * | 4/2003 | Okazawa et al. | 347/68 |
| 2003/0174107 | A1 * | 9/2003 | Watanabe et al. | 345/87 |

FOREIGN PATENT DOCUMENTS

| | | |
|---|---|---|
| JP | 2002-244580 | 8/2002 |
| JP | 2003-330041 | 11/2003 |

* cited by examiner

*Primary Examiner* — Joseph Haley
*Assistant Examiner* — Nicholas Lee
(74) *Attorney, Agent, or Firm* — Finnegan, Henderson, Farabow, Garrett & Dunner, L.L.P.

(57) ABSTRACT

A liquid crystal display device comprising a liquid crystal display panel 21 having pixels each disposed on an intersection between plural scan lines and plural signal lines, a flexible wiring substrate having mounted thereon a drive IC 24 electrical connected to the liquid crystal display panel 21 for supplying video signals via video signal lines, to one video signal line of which N number of the signal lines are allocated, wherein N is an integer of two or more, an analog switch circuit switch-connected to a signal line selected from the N number of the signal lines in each of the video signal lines, and the control lines 26 formed across a region in which the drive IC 24 has been mounted on the flexible wiring substrate 23 and drawn from a center of the flexible wiring substrate 23 onto the liquid crystal display panel 21 for supplying at least a power source for driving the analog switch circuit or a control signal.

2 Claims, 2 Drawing Sheets

LIQUID CRYSTAL DISPLAY DEVICE

BACKGROUND OF THE INVENTION

1. Field of the Invention

The present invention relates to a liquid crystal display device and particularly to an improvement in the control lines that controls an analog switch circuit in the liquid crystal display device having a system of apportioning to a plurality of signal lines video signals supplied from video signal lines.

2. Description of the Prior Art

In recent years, liquid crystal display devices having features of light weight, small thickness and small power consumption have widely been used as liquid crystal display devices for information equipment, such as personal computers and word processors, and for video equipment, such as television sets, video cameras, digital cameras and car navigation systems. A liquid crystal display device has a liquid crystal display panel having liquid crystal materials sealed between two substrates (an array substrate and a counter electrode) and, in the liquid crystal display panel, a voltage on-off operation controls the orientation of the liquid crystal materials a transmitted light on-off operation performs an image display.

In the liquid crystal display panel, as means for supplying a power source and control signals for a scan line driving circuit, a power source for the counter electrode and a power source connected to an auxiliary capacitor, a flexible wiring substrate having mounted thereon a drive IC for supplying video signals has been utilized. In this case, the above power sources and control signals are supplied generally not via the drive IC, but using the opposite end portions of the flexible wiring substrate without use of the wiring portion for supplying the video signals.

On the other hand, in recent years, a signal line driving system has been proposed, in which an analog switch circuit is formed on an array substrate constituting a liquid crystal display panel, the ratio of the number of video signal lines from a drive IC and the number of signal lines on the array substrate is set to be 1:2, and one of the two type of signal lines is selected using the analog switch circuit to supply the video signal, whereby it is made possible to reduce the number of the drive IC. In a liquid crystal display panel especially using a polysilicon thin film transistor, this signal line driving system is easy to adopt. Incidentally, the ratio of 1:2 of the number of the video signal lines and the number of the signal lines on the array substrate is not limitative. The ratios of 1:3 and 1:4 are possible.

In the signal line driving system, it is necessary to supply the power sources and control signals to the analog switch circuit on the array substrate. The control lines for supplying the power sources and control signals are also wired toward the opposite end portions of the flexible wiring substrate having the drive IC mounted thereon (refer, for example, to JP-A 2003-270660).

The liquid crystal display device disclosed in the prior art JP-A 2003-270660 is provided with a liquid crystal display panel and a drive circuit for supplying video signals to video signal lines formed on the liquid crystal display panel. The drive circuit comprises a first drive circuit formed by the same process as pixels provided on the liquid crystal display panel and a second drive circuit connected to the liquid crystal display panel formed. The first drive circuit is constituted by a switching circuit capable of allocating outputs of the second drive circuit to a plurality of video signal lines. The prior art JP-A 2003-270660 discloses in FIG. 8 or 9 an example of forming on the opposite end portions allocation control signal lines for driving the switching circuit.

In recent years, the number used per panel of a drive IC used for a liquid crystal display device has been directed to reduction and moreover the aspect ratio of display panel has been shift from 4:3 to 16:9. In this case, when a division control signal lines for supplying the power sources and control signals to the switching circuit is pulled along from the opposite end portions of the flexible wiring substrate having the drive IC mounted thereon, the wiring length on the array substrate becomes long to possibly entail a problem of the voltage depression owing to interconnection resistance, the delay signals, and attenuation of the control signals.

Particularly in the case of forming the analog switch circuit on the array substrate and performing a signal line selection drive method that switches signal lines for supplying the video signals, based clock frequency is high and easy to make noise, and the delay signals and attenuation of the signals possibly affects greatly the quality of images to be displayed on the liquid crystal display panel.

The present invention has been proposed in view of the conventional actual situation, and the object thereof is to provide a liquid crystal display device capable of suppressing the wiring length of control signal lines for supplying power sources or control signals to an analog switch circuit to the minimum and suppressing the deterioration of an image quality resulting from the voltage dropping, the signal delay, and the control signal attenuation.

SUMMARY OF THE INVENTION

To accomplish the above object, the present invention provides a liquid crystal display device comprising a liquid crystal display panel having pixels each disposed on an intersection between plural scan lines and plural signal lines, a flexible wiring substrate having mounted thereon a drive IC electrical connected to the liquid crystal display panel for supplying video signals via video signal lines, to one video signal line of which N number of the signal lines are allocated, wherein N is an integer of two or more, an analog switch circuit switch-connected to a signal line selected from the N number of the signal lines in each of the video signal lines, and the control lines formed across a region in which the drive IC has been mounted on the flexible wiring substrate and drawn from a center of the flexible wiring substrate onto the liquid crystal display panel for supplying at least a power source for driving the analog switch circuit or a control signal.

According to the present invention, as described above the control lines formed across a region in which the drive IC has been mounted on the flexible wiring substrate and drawn from a center of the flexible wiring substrate onto the liquid crystal display panel for supplying at least a power source for driving the analog switch circuit or a control signal, and the length of the control lines can be minimized.

According to the present invention, the length of the control lines for supplying the power source or control signal to the analog switch circuit can be suppressed to the minimum, and it is possible to suppress a voltage drop by interconnection resistance and suppress signal delay and signal attenuation, thereby enabling provision of a high-grade liquid crystal display device exhibiting no image degradation. Also, according to the present invention, in performing the signal line selection drive by the analog switch circuit on the array substrate, even when the flexible wiring substrate having mounted thereon the drive IC for supplying a video signal is installed only at one place, it is possible to supply the power source or control signal to the analog switch circuit without a voltage dropping and signal delay by interconnection resistance.

The above and other objects, characteristic features and advantages of the present invention will become apparent to those skilled in the art from the description to be given herein below with reference to the accompanying drawings.

DETAILED DESCRIPTION OF THE PREFERRED EMBODIMENT

An embodiment of the liquid crystal display device according to the present invention will be described hereinafter with reference to the drawings.

Figure 1:
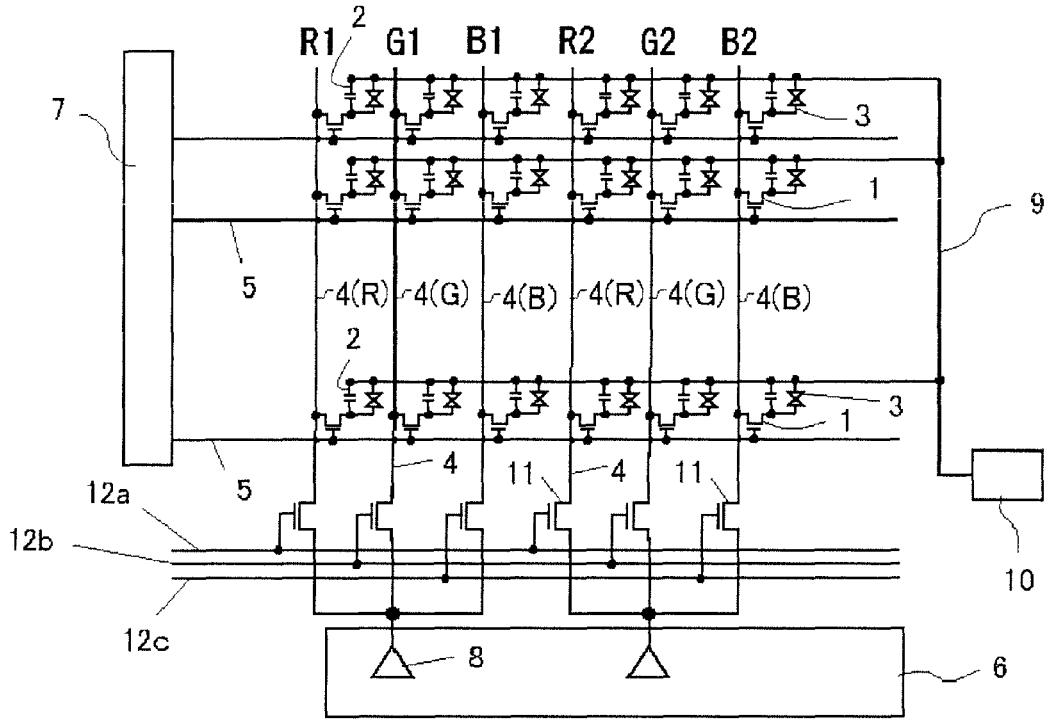
FIG. 1 is a diagram showing an example of the configuration of a liquid crystal display device equipped with an analog switch multiplexer circuit.

First, the schematic configuration of a liquid crystal display device having a system of signal line selection drive method by an analog switch circuit will be described. FIG. 1 shows an example of the liquid crystal display device having the system of signal line selection drive by the analog switch multiplexer circuit.

The liquid crystal display device is configured such that pixel transistors 1 comprising n-channel transistors for driving pixel electrodes are arranged in a matrix form. In the case of a color liquid crystal display device, for example, one pixel is constituted by three pixel electrodes driven by each three pixel transistors 1 corresponding respectively to red (R), green (G) and blue (B) colors. Of the three color pixel transistors, the red pixel transistors 1 are connected respectively to signal lines R1, R2, . . . positioned on the left side when seen from the pixel electrode on a column to column basis, the green pixel transistors 1 are connected respectively to signal lines G1, G2, . . . positioned on the left side when seen from the pixel electrode on a column to column basis, and the blue pixel transistors 1 are connected respectively to signal lines B1, B2, . . . positioned on the left side when seen from the pixel electrode on a column to column basis.

An auxiliary capacitor 2 for a pixel and a liquid crystal layer 3 are electrical connected to a drain electrode of each pixel transistor 1. In addition, plural signal lines 4 are electrical connected to a source electrode of each pixel transistor 1, and plural gate line (scan line) 5 are electrical connected to a gate electrode of each pixel transistor 1. Of these lines, the plural signal lines 4 are driven by a signal-line driving circuit 6 and plural gate electrode 5 are driven by a scan-line driving circuit 7. Furthermore, the plural signal lines 4 are electrical connected to a D/A (Digital to Analog) converter 8 from which voltage of an analog amplitude in accordance with a gradation sequence of image data to be displayed. Moreover, the auxiliary capacitor 2 and liquid crystal layer 3 on the side of a counter electrode are driven via a counter electrode control line 9 by a counter-electrode driving circuit 10 installed outside of the analog switch multiplexer circuit.

Signal lines 4(R), 4(G) and 4(B) of each pixel transistor 1 are connected respectively to n-channel transistors 11 constituting a analog switch multiplexer circuit. Signal control lines 12*a*, 12*b* and 12*c* for supplying control signals to the analog switch multiplexer circuit comprising these transistors 11 correspond respectively to the transistors 11 serving as switches connected to the signal lines 4(R), 4(G) and 4(B). In the liquid crystal display device of the present embodiment, by switching outputs of the signal-line driving circuit 6 with the transistors 11, the outputs of one signal-line driving circuit 6 can drive three signal lines 4. In the liquid crystal display device of the present embodiment, N number (N is an integer of two or more) of signal lines are allocated to one video signal line and, here, N=3. That is to say, in each video signal line, a signal line selected from the N number of signal lines (three signal lines) is switch-connected.

In the liquid crystal display device of the aforementioned configuration, the gate lines 5 are sequentially scanned with the scan-line driving circuit 7, voltage allowing the pixel transistor 1 connected to the same gate line 5 to be brought to an on-state is applied to the gate line 5 and, at the same time, voltage as video signal in accordance with image data to be displayed is applied to the signal line 4. As a result, desirable voltage is applied to the auxiliary capacitor 2 and liquid crystal layer 3 via the pixel transistor 1. By applying voltage, which allows the pixel transistor 1 connected to the same gate line 5 to be brought to an off-state with the scan-line driving circuit 7, to the gate line 5, voltage applied to the auxiliary capacitor 2 and liquid crystal layer 3 after bringing the pixel transistor 1 to the off-state is retained until the next scanning operation. In the liquid crystal display device, the scanning operations of the gate line 5 are sequentially performed with the scan-line driving circuit 7, and the pixel transistors 1 connected to the gate line 5 are brought to an on-state sequentially to display an overall screen.

Figure 2:
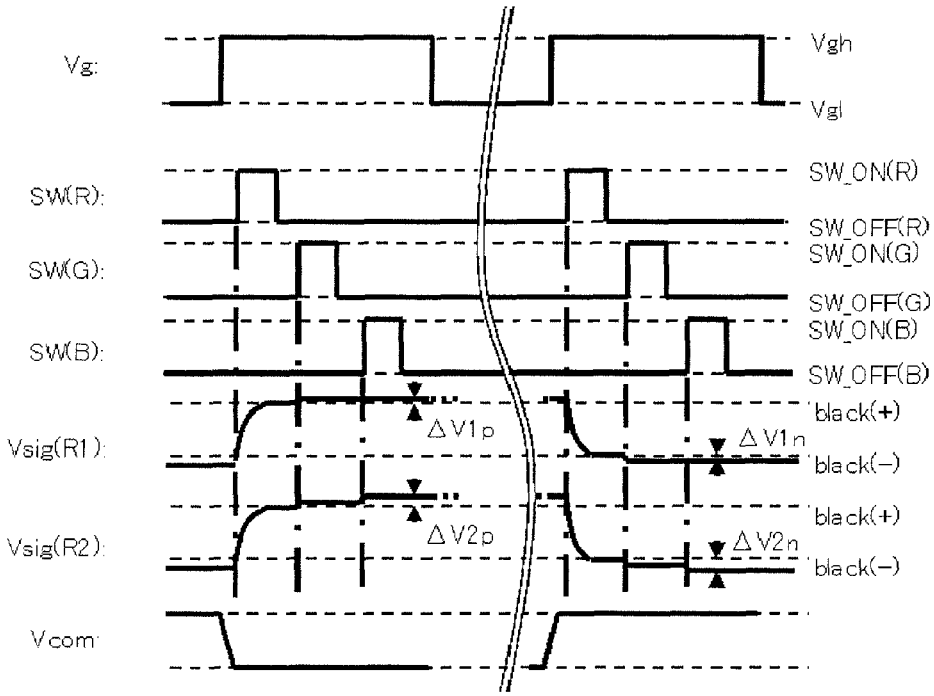
FIG. 2 is a timing chart showing the driving operation in the liquid crystal display device equipped with the analog switch multiplexer circuit and illustrating a voltage variation in the leftmost source line of an effective display region.

In addition, in the liquid crystal display device, the signal line selection drive is performed at the timing as shown in FIG. 2. Incidentally, FIG. 2 shows gate line voltage Vg applied to the gate line 5 with the scan-line driving circuit 7, a control signal SW(R) supplied to the gate electrode of the transistor 11 connected to the signal line 4(R), a control signal SW(G) supplied to the gate electrode of the transistor 11 connected to the signal line 4(G), a control signal SW(B) supplied to the gate electrode of the transistor 11 connected to the signal line 4(B), voltage Vsig(R1) of the signal line 4(R1) connected to the pixel transistor 1 positioned at the leftmost pixel in an effective display region, voltage Vsig(R2) of the signal line 4(R2) connected to the pixel transistor 1 disposed rightward by three pixels from the signal line 4(R1) and a counter electrode potential Vcom.

That is to say, in the liquid crystal display device, when the gate line voltage Vg transits from voltage Vgl for bringing the pixel transistor 1 to an off-state to voltage Vgh for bringing the pixel transistor 1 to an on-state, the control signals SW(R), SW(G) and SW(B) are sequentially of high levels within a horizontal scanning term, respectively. In other words, in the liquid crystal display device, the signal lines 4(R), 4(G) and 4(B) are sequentially selected in the order mentioned within the horizontal scanning term in which the gate line voltage Vg becomes voltage Vgh. In accordance with this, in the liquid crystal display device, as shown by voltages Vsig(R1) and Vsig(R2), display signals are written in the pixel electrode connected to the pixel transistor 1 corresponding to the selected transistor 11. Incidentally, shown here is the manner in which black color display signals are written in the pixel electrode. The pixel transistor 1 connected to the pixel electrode having the display signals written therein retains the voltages Vsig(R1) and Vsig(R2) until the next horizontal scanning operation. To the contrary, as shown in FIG. 2 as the counter electrode potential Vcom, signals having the polarity opposite to that of the black color display signals written in the pixel electrode are supplied to the counter electrode within each horizontal scanning term.

Thus, in the liquid crystal display device using the analog switch multiplexer circuit, the overall screen can be displayed with the output terminals of one-third signal-line driving circuits 6 of the total number of the signal lines 4 and the transistors 11 functioning as changeover switches through the time-division selection of the signal lines during the gate line selection term.

Figure 3:
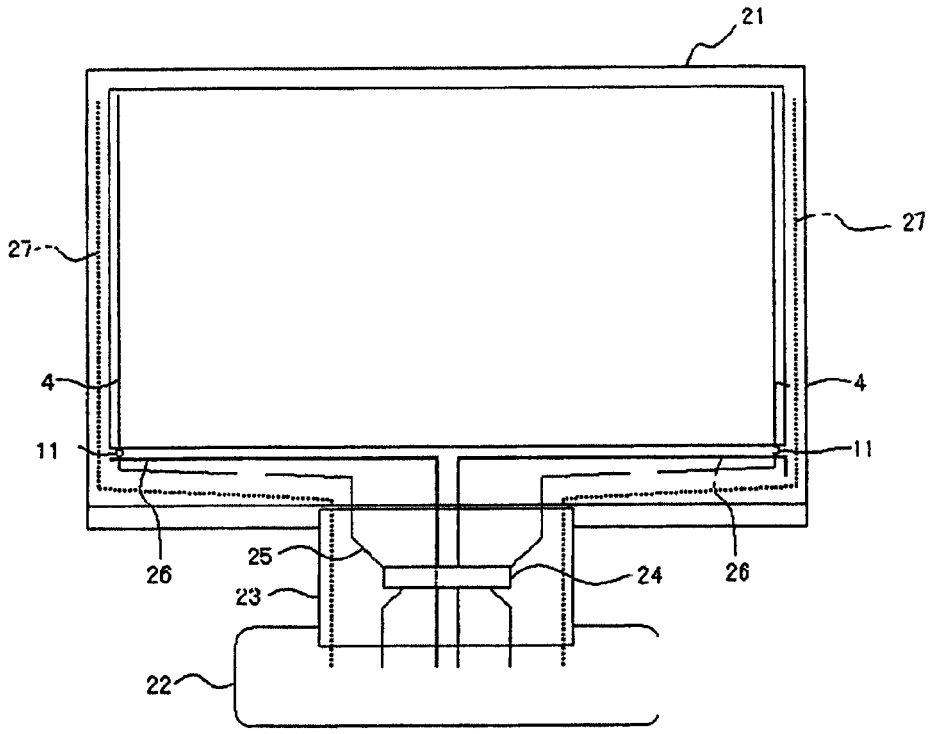
FIG. 3 is a schematic plan view showing the control lines-drawn state in a liquid crystal display device of the present invention.

Next, in the liquid crystal display device using the analog switch multiplexer circuit, how to draw the control lines along the liquid crystal display panel will be described. The liquid crystal display device is configured as shown in FIG. 3 such that the liquid crystal display panel 21 and drive circuit substrate 22 are electrically connected to each other via the flexible wiring substrate 23. On the flexible wiring substrate 23 the drive IC 24 corresponding to the signal-line driving circuit 6 is mounted and, from the drive IC 24, the video signal line 25 is drawn.

The video signal line 25 drawn from the drive IC 24 is electrical connected to the three signal lines 4(R), 4(G) and 4(B) via the transistor 11 functioning as a changeover switch in the analog switch multiplexer circuit. In a WXGA (1280 dots×800 dots) panel, for example, when there is one drive IC 24 supplying video signals, the number of outputs of the drive IC 24 becomes 960 lines in case of the ratio of the video signal line 25 and signal lines 4(R), 4(G) and 4(B) is 1:4 and the number of outputs of the drive IC 24 becomes 768 lines in case of the ratio of the video signal line 25 and signal lines 4(R), 4(G) and 4(B) is 1:5.

On the other hand, besides the video signal line 25, it is necessary to form both the control lines 26 (corresponding to signal control lines 12*a*, 12*b* and 12*c*) for supplying control signals or a power source to the transistor 11 formed on the array substrate of the liquid crystal display panel 21 and the scan-line driving circuit line 27 for supplying control signals or a power source to the scan-line driving circuit 7. In the liquid crystal display device of the present embodiment, the two control lines 26 are wired at the center position of the flexible wiring substrate 23 so as to intersect the installation region of the drive IC 24 and drawn to the center position of the liquid crystal display panel 21. The two drawn the control lines 26 are wired in the horizontal direction (opposite directions), respectively. That is to say, the control lines 26 extend from the center to the opposite end portions of the liquid crystal display panel 21 in the opposite directions. The scan-line driving circuit lines 27 are connected to the opposite sides of the liquid crystal display panel 21 via the opposite sides of the flexible wiring substrate 23.

Here, in order to wire the control lines 26 so as to intersect the installation region of the drive IC 24, it is preferred that a package that is a so-called Chip On Film (COF) be adopted as the flexible wiring substrate 23. In the COF, since there is no need to bore a hole at the portion at which the drive IC 24 of the flexible wiring substrate 23 is mounted, it is possible to dispose on the lower side of the drive IC 24 wires (the control lines 26) not using the drive IC 24 as an intervening substance. As the flexible wiring substrate having mounted thereon the drive IC 24 for supplying video signals to the liquid crystal display panel, a TCP (Tape Carrier Package) has heretofore been used. In the case of the TCP, however, since it is necessary to bore a hole that is one size larger than the drive IC 24 at the portion at which the drive IC 24 of the flexible wiring substrate is to be mounted, it is impossible to install on the lower side of the drive IC 24 wires not using the drive IC 24 as the intervening substance.

In the liquid crystal display device of the present embodiment, as described above, the COF is used as the package for the flexible wiring substrate 23 having the drive IC 24 mounted thereon, the control lines 26 is disposed on the lower side of the drive IC 24 not using the drive IC 24 as an intervening substance, and the control lines 26 is used to supply a power source or control signals to the analog switch multiplexer circuit. With this, it is possible to shorten the wire length of the control lines 26 on the array substrate of the liquid crystal display panel 21 dramatically and supply a power source or control signals without a voltage dropping and signal delay by interconnection resistance.

Figure 4:
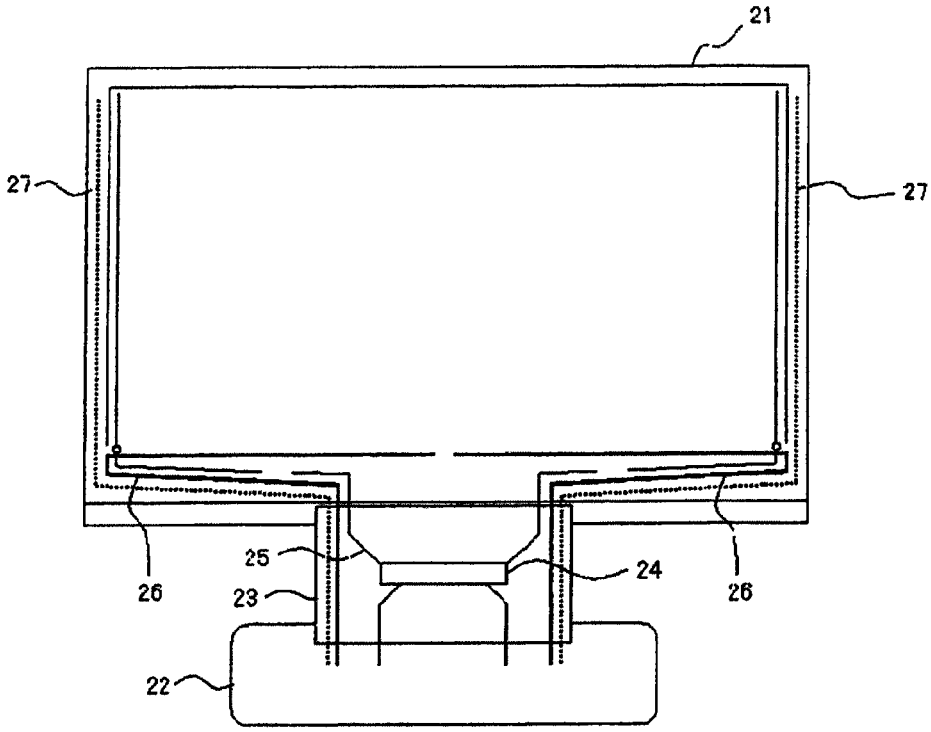
FIG.4 PRIOR ART
FIG. 4 is a schematic plan view showing the control lines-drawn state in a conventional liquid crystal display device.

On the other hand, FIG. 4 shows a prior art liquid crystal display device, in which the opposite ends of the flexible wiring substrate 23 having the drive IC 24 mounted thereon are used to supply the power source and control signals of the analog switch circuit. That is to say, the configuration thereof is such that the control lines 26 for supplying the power source or control signals are wired around the video signal line 25 and at the positions of the opposite ends of the flexible wiring substrate 23 having the drive IC 24 mounted thereon and as returning toward the inside of the array substrate of the liquid crystal display panel 21. This configuration the wire length of the control lines becomes long to pose a problem making the interconnection resistance large.

What is claimed is:

1. A liquid crystal display device comprising:

a liquid crystal display panel having pixels disposed on intersections between a plurality of scan lines and signal lines;

a flexible wiring substrate having mounted thereon a drive IC electrically connected to the liquid crystal display panel, the drive IC being mounted on the flexible wiring substrate by means of chip-on-film technology and supplying video signals to one of N number of the signal lines allocated to the drive IC, wherein N is an integer of two or more;

an analog switch circuit switch-connected to the one of the N number of the signal lines; and control lines formed across a region in which the drive IC has been mounted on the flexible wiring substrate, the control lines being insulated from the drive IC and drawn from a center of the flexible wiring substrate onto the liquid crystal display panel for supplying control signal for driving the analog switch circuit, wherein the control lines comprise two lines, the two lines:

extending in opposite directions from a portion of the liquid crystal display panel corresponding to a central portion of the drive IC, and ending at opposite end portions of the liquid crystal display panel.

2. A liquid crystal display device according to claim 1, further comprising scan-line driving circuit lines disposed at opposite sides of the liquid crystal display panel and at opposite sides of the flexible wiring substrate.

* * * * *

UNITED STATES PATENT AND TRADEMARK OFFICE

CERTIFICATE OF CORRECTION

PATENT NO. : 8,319,719 B2
APPLICATION NO. : 12/370931
DATED : November 27, 2012
INVENTOR(S) : Tomohiro Matsumoto et al.

It is certified that error appears in the above-identified patent and that said Letters Patent is hereby corrected as shown below:

On the Title page, at paragraph (73), please replace the Assignee "Toshiba Matsushita Display Technology Co., Ltd., Tokyo (JP)" with "Japan Display Central Inc., Saitama (JP)."

Signed and Sealed this
Nineteenth Day of February, 2013

Teresa Stanek Rea
*Acting Director of the United States Patent and Trademark Office*